United States Patent [19]

Ernstsen

[11] Patent Number: 4,860,458

[45] Date of Patent: Aug. 29, 1989

[54] BOW STRING PEEP SIGHT

[76] Inventor: Leif Ernstsen, 2 D, Lilletjernveien, N-4550 Farsund, Norway

[21] Appl. No.: 119,126

[22] Filed: Nov. 10, 1987

Related U.S. Application Data

[63] Continuation-in-part of Ser. No. 903,902, Sep. 4, 1986, abandoned, and a continuation-in-part of Ser. No. 737,084, May 23, 1985, abandoned.

[30] Foreign Application Priority Data

May 23, 1984 [DK] Denmark ..... 2522/84

[51] Int. Cl.[4] ..... F41G 1/00; F41B 5/00

[52] U.S. Cl. ..... 33/265; 124/87; 124/90

[58] Field of Search ..... 33/233, 234, 241, 242, 33/244, 251, 253, 261, 265; 124/87, 90, 92, 23 R, 24 R; 356/247; D22/5.8

[56] References Cited

U.S. PATENT DOCUMENTS 3,703,770 11/1972 Sofield ..... 33/265
3,703,771 11/1972 Saunders ..... 33/265
4,011,853 3/1977 Fletcher ..... 33/265
4,454,857 6/1984 Miller et al. ..... 33/265
4,656,746 4/1987 Gillespie ..... 33/265

*Primary Examiner*—William A. Cuchlinski, Jr.
*Assistant Examiner*—Patrick R. Scanlon
*Attorney, Agent, or Firm*—Cushman, Darby & Cushman

[57] ABSTRACT

A bow string peep sight comprises a disk having a string hole for receiving a bow string to be kept in a position perpendicular to the disk. Outside the string hole the disk is provided with a transparent sighting area having the shape of a sector of a circle ring concentric to the string hole and extending over an angle of between 120° and 270°. When the bow is drawn the disk is tilted, thereby revealing to the archer a single sighting opening outwardly appearing to be limited by two elliptic arcs. The sighting hole is made sufficiently small to ensure an exact aiming. Owing to the great angular distance between the ends of the sighting area, the single sighting opening is formed independent of the twist of the bow string.

5 Claims, 2 Drawing Sheets

BOW STRING PEEP SIGHT

This is a continuation-in-part application of Ser. No. 903,902, filed Sept. 4, 1986, which is a continuation of Ser. No. 737,084 filed May 23, 1985, now both abandoned.

TECHNICAL FIELD

This invention relates to a peep sight for mounting on the bow string of an archery bow and of the type comprising a body adapted to be fastened on a bow string in a position perpendicular thereto and provided with a transparent area inwardly as well as outwardly limited by circular arcs concentric to said box spring.

BACKGROUND ART

A bow string peep sight of this type is described in U.S. Pat. No. 4,454,857, said peep sight comprising a wheel having a central elongated, hollow hub portion extending perpendicular to the plane of the wheel for receiving the bow string. The wheel is provided with a continuous rim portion connected to the hub by spokes and leaving a transparent sighting area between the rim portion and the hub. The wheel of the known peep sight is plane at one side but is provided on the opposite side with a conical recess ensuring said sighting area to be sharp-edged at its outer limitation. When such a peep sight is tilted owing to the drawing of the string a sighting aperture is revealed—provided the eye is close to the sight—between the hub and rim, said aperture being limited inwards by a straight line defined by the outer face of the hub and outwards by a relatively long elliptic arc defined by the inner edge of the rim portion. In far the most cases, a spoke is positioned in the visual fields of the sighting apertures. However, the presence of a spoke within the used sighting aperture blurs the view through said aperture to a certain degree. Furthermore, the elliptic arc limiting each sighting aperture outwards has a close resemblance to a semi-circle and, therefor in most cases the sighting aperture is too large for ensuring a correct aiming. In most cases, it is inconvenient that two sighting apertures are formed—one on each side of the string—since the wrong aperture may be chosen especially when the aiming period is very short.

OBJECT OF THE INVENTION

An object of this invention is to provide a bow string peep sight of the type concerned which ensures a sight being as distinctive as possible, and which in use allows only a single sighting aperture to be visible at a time, where the sighting aperture has limited dimensions and is approx. quadrangularly limited by four elliptic arcs ensuring an exact sighting. A further object of this invention is to ensure that the sighting aperture is always free of disturbing elements.

DISCLOSURE OF THE INVENTION

According to the present invention the body constituting the peep sight is provided with a transparent sighting area shaped as a sector of a circle ring extending over an angle of between 120° and 270°, whereby at the front side as well as at the rear side of the body said sighting area is outwardly limited by a front outer circular arc and a rear outer circular arc, respectively, where said two arcs are positioned in two spaced planes perpendicular to the hub axis. The sighting area is furthermore inwardly limited by two edges of axially spaced portions of the body leaving between them a recess occupied by a transparent medium—normally air.

As a result the outer limitation of the sighting aperture appears to be composed of a first outer elliptic arc corresponding to a portion of the outer front circular arc and of a second outer elliptic arc corresponding to a portion of the outer rear circular arc and forming an angle with said first outer elliptic arc. In addition, the inner limitation of the sighting aperture appears as two elliptic arcs also defined by said edges and forming an angle with each other and with the outer elliptic arc. Thus the sighting aperture appearing when the peep sight is tilted owing to a drawing of the string comprises a relatively small area. Furthermore it is easy for the eye to imagine cross hairs interconnecting the corners of the quadrangle and thereto to define the center of the sighting aperture. As a result, a possibility of a very exact aiming exists. Suitably the body of the peep sight is composed at two round bowlshaped plates interconnected at their outer edges and provided with alike sighting areas, said sighting areas being defined by a transparent portion, for example an opening, shaped as a section of a circle ring covering an angle of between 120° and 270°. Such a body can be given a larger thickness and thereby a more distinct area than an ordinary more disk-like body, and nevertheless it can be of a lower weight than such a body.

DESCRIPTION OF PREFERRED EMBODIMENTS

Figure 1:
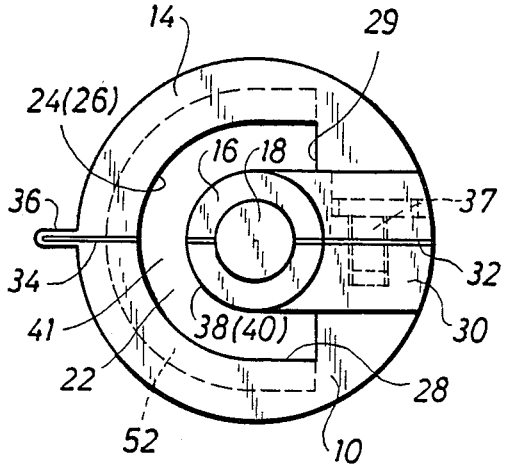
FIG. 1 is an enlarged view of an embodiment of the peep sight of the present invention.
Figure 2:
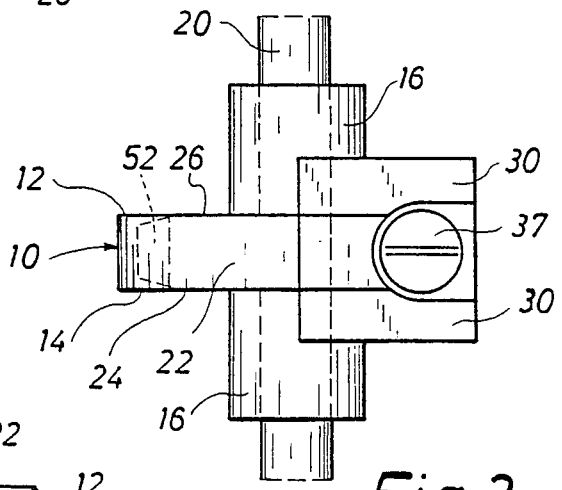
FIG. 2 is a side elevational view of the peep sight of FIG. 1.
Figure 3:
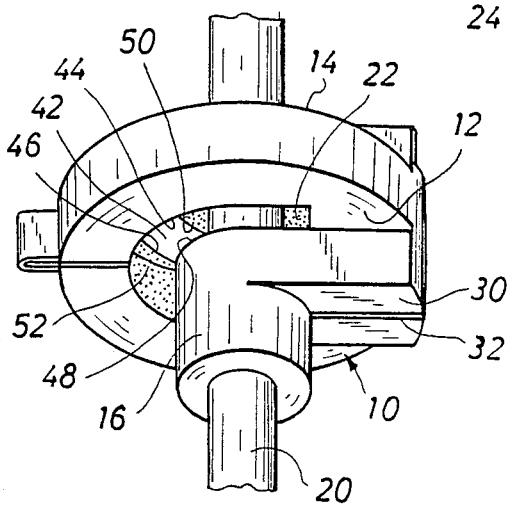
FIG. 3 is a perspective view of the peep sight of FIGS. 1 and 2 as it appears to the archer when the bow is drawn.

The peep sight of FIGS. 1 to 3 comprises a cylindrical body 10 having a plane front side face 12 and spaced therefrom a plane rear side face 14. At its central portion, the body 10 is on both sides provided with a hub 16 extending outwards from the corresponding body side face 12 and 14, respectively, and having a hub bore 18 adapted to receive a bow string 20 shown in FIGS. 2 and 3 only.

The body 10 is provided with a transverse hollow area 22 at each side of the body 10 outwardly limited by a half-circle 24 and 26, respectively, and at the ends thereof by lines 28 tangential thereto. The hollow area 22 has a bottom 29 tangential to the outside of the hubs 16.

Opposite to the half-circles 24 and 26 each hub 14 is provided with a thickening 30 formed integral with the body 10 and provided with an axially extending slit 32 also extending through the portions of the hubs 16 outside the thickening 30. On the same plane as the slit 32, a corresponding slit 34 extends through the outer part of the body 10, which is thereby divided into two halves interconnected by a hinge member 36 bridging the slit 34. Consequently, it is possible to open the peep sight when it is to be arranged on the bow string whereupon the slit 32 can be squeezed together by means of a screw 37 axially interconnecting the two halves in which the slit 32 divides the thickening 30, and the peep sight can be fastened to the bow string. Furthermore, the screw 37 allows a simple adjustment of the position, i.e. also the angular position, of the peep sight on the bow string.

The semi-circles 24 and 26 define together with inner edges 38 and 40 of the hubs 16 a transparent sighting opening 41 of the peep sight.

When the bow string is drawn into shooting position and therefore takes up a slanted position, the peep sight is correspondingly tilted whereby only a portion of the sighting opening 41 forms a visual sighting aperture 41, cf. FIG. 3. This sighting area is limited by two outer elliptic arcs 44 and 46 corresponding to a portion of the rear semi-circle 24 and of the front semi-circle 26, respectively, and by opposite elliptic arcs 48 and 50 corresponding to a portion of the rear inner edge 38 and the front inner edge 40, respectively, of the hubs 14. It is obvious that the size and the position of the virtual sighting aperture 42 relative to the bow string are the same within a certain twisting angle of the bow string of up to 180°.

The quadrangular shape of the sighting aperture 42 ensures a much more accurate aiming than the half-moon shaped sighting apertures obtained by the hitherto known peep sights of the type in question. Unlike the previously obtained half-moon shaped apertures the quadrangular shape implies that it is easy to imagine cross hairs interconnecting the corners of the quadrangle and thus to find the exact center thereof even when a fast aiming is necessary.

The shape and dimensions of the peep sight of the present invention depend inter alia on the individual archer and the bow used. Bow strings are standardized as to thickness depending on the strength of the bow. Therefore the diameter of the hub bore 18 should fit the actual bow string. Furthermore the size of the virtual sighting aperture depends to a certain degree on the applications. In target shooting, a sighting aperture is for instance attempted to be as small as possible, whereas the bow hunter might prefer a slightly larger hole for a better survey. As to the outer dimensions of the peep sight, it is appropriate to chose such sights preventing the archer from simultaneously seeing both the target through the sighting aperture 42 and outside the body 10 with his shooting eye. In practice the max. diameter of the body is from 10 to 15 mm.

Although not strictly necessary it turned out to be appropriate that the body 10 is provided with an inner recess 52 at the outer periphery of the transparent sighting area 41, wherby the semicircles 24 and 26 define relatively sharp edges of the transparent area 41. As a result the elliptic arcs 44 and 46 limiting the sighting aperture 42 outwardly appear very sharp and in no way blurred as may be the case when the said two semi-circles are interconnected by a cylindrical fase, possibly owing to reflex.

Figure 4:
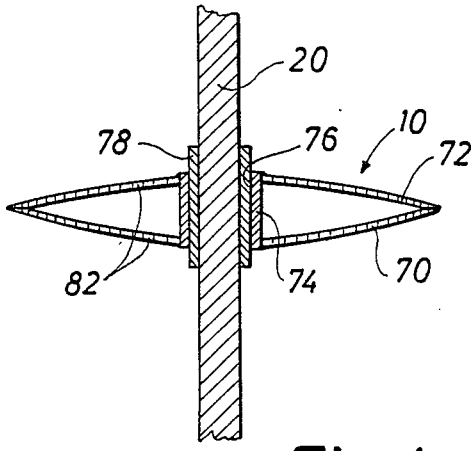
FIG. 4 is an enlarged cross-sectional view of another embodiment of a peep sight of the present invention.
Figure 5:
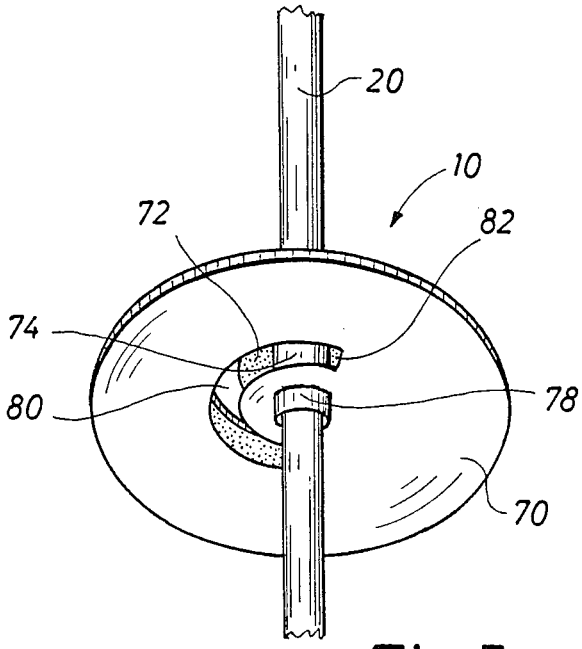
FIG. 5 is a perspective view of the peep sight of FIG. 4 as it appears to the archer when the bow is drawn.

Another embodiment of a peep sight of the present invention is shown in FIGS. 4 and 5. The body 10 of this peep sight comprises in principle two thin round bowl-shaped plates 70 and 72, each plate being provided with an opening 82 shaped as a sector of a circular ring. The plates 70 and 72 are conveniently made from aluminium or a similar light material and are at their center interspaced by a hub 74 having a hub bore 76 adapted to receive the bow string 20. For fixing the peep sight on the bow string 20 a slit tube piece 78 of al elastic material is used. The inner diameter of the tube corresponds to the thickness of the bow string, whereas the outer diameter of the tube corresponds to the hub bore 76 of the hub 74. The tube 78 is opened and the bow string is inserted, whereafter the tube 78 is put into the hole 76 in the hub 74 to wedge the peep sight on the bow string 14. The edges of the plates 70 and 72 may be joined together with glue or in any other convenient manner whereby an aerodynamic shape is achieved. With an appropriate distance between the plates 70 and 72, and the disk in the slanted shooting position as appears from FIG. 5 the openings 72 reveal a virtual sighting aperture 80 of a quadrangular-looking shape actually consisting of four small elliptical areas.

Besides the described embodiments the peep sight of the present invention may be given many other exterior shapes depending on the choice of material and the appearance preferred. It is essential that the sighting area through which the archer peeps and aligns the peep sight and target is shaped as a sector of a circular ring concentric to the bow string and in a plane perpendicular to the longitudinal axis of the bow string. Further, the dimension of the sighting area in the longitudinal direction of the bow string must be adjusted so that when the bow is drawn, there will appear a virtual sighting aperture which will be constant with respect to size, shape, and position in relation to the bow string even if the string sight is rotated a certain angle around the longitudinal axis of the bow string.

Above, the sighting area is described as an aperture shaped as a sector of a circular ring in one or two disks. It is possible, however, to accomplish this sighting area by making the disk or plate from a transparent material and mask the disc or plates os that a transparent area shaped as a sector of a circular ring is left.

I claim:

1. A peep sight for mounting on the bow string of an archery bow comprising a body having a main plane, a front side, and a rear side, and being provided with a central elongated hub portion defining a hub axis perpendicular to said main plane and being provided with a hub bore concentric to said hub axis and adapted to receive a bow string, said hub portion further defining an opaque inner portion of said body, said body being provided with an opaque outer portion and between said outer and said inner portion with a transparent sighting area adapted to constitute a sighting aperture and being shaped as a sector of a circle ring extending over an angle of between 120° and 270°, said sighting area being outwardly limited at said front side as well as at said rear side by an outer front circular arc and an outer rear circular arc, respectively, said circular arcs being situated respectively in two spaced planes parallel to said main plane, thereby causing, when the peep sight is tilted to a line of sight, the outer limitation of said sighting aperture to appear as composed of a first outer elliptic arc corresponding to a portion of said outer front circular arc and of a second outer elliptic arc corresponding to a portion of said outer rear circular arc and forming an angle with said first outer elliptic arc, said sighting area being inwardly defined by two edges of axially spaced portions of said body defining a front inner circular arc and a rear inner circular arc and leaving between them a recess occupied by a transparent medium, thereby causing, when the peep sight is tilted to a line of sight, the inward limitation of said sighting aperture to appear as composed of a first inner elliptic arc corresponding to a portion of said inner rear circular arc and a second elliptic arc corresponding to a portion of said inner front circular arc and forming an angle with said first inner elliptic arc, whereby said sighting aperture of the peep sight appears as a quadrangle having elliptic sides and sharp edges.

2. A peep sight as claimed in claim 1, in which said hub portion is provided between said front side and said rear side with said recess and the edges between said recess and the outer side of the hub portion constitute said front circular arc and said rear inner circular arc, respectively.

3. A peep sight as claimed in claim 2 in which said recess is open towards said hub bore.

4. A peep sight as claimed in claim 1, said body being provided between said outer front circular arc and said outer rear circular arc with an outwardly extending recess.

5. A peep sight for mounting on the bow string of an archery bow comprising a body having a main plane, a front side, and a rear side, and being provided with a central elongated hub portion defining a hub axis perpendicular to said main plane and being provided with a hub bore concentric to said hub axis and adapted to receive a bow string, said body being composed of two round bowl-shaped plates surrounding a transparent medium, said plates being interconnected along their outer edges and at their central portion being kept in a mutual distance by said hub portion, each plate being provided with an opaque outer portion and an opaque inner portion.

said plates being provided between their said outer and inner portions with alike transparent areas axially spaced and arranged opposite each other, and adapted together to constitute a sighting aperture, each said transparent area being outwardly limited by an outer edge defined by a front outer circular arc and a rear outer circular arc, respectively, and inwardly by an inner edge defined by a front inner circular arc and a rear inner circular arc, respectively, each circular edge extending over an angle of between 120° and 270°, said outer edges leaving between them an outer recess occupied by said transparent medium and said inner edges leaving between them an inner recess occupied by said transparent medium, thereby causing, when the peep sight is tilted to a line of sight, the outer limitation of said sighting aperture to appear as composed of a first outer elliptic arc corresponding to a portion of said outer front circular arc and of a second outer elliptic arc corresponding to a portion of said outer rear circular arc and forming an angle with said first outer elliptic arc, and the inward limitation of said sighting aperture to appear as composed of a first inner elliptic arc corresponding to a portion of said inner rear circular arc and a second elliptic arc corresponding to a portion of said inner front circular arc and forming an angle with said first inner elliptic arc, whereby said sighting aperture appears as a quadrangle having elliptic sides and sharp edges.

* * * * *